US007116053B2

(12) United States Patent
Claus et al.

(10) Patent No.: US 7,116,053 B2
(45) Date of Patent: Oct. 3, 2006

(54) METHOD FOR ARC ATTACHMENT STABILIZATION

(75) Inventors: Holger Claus, Lake Forest, CA (US); Andre Piotrowski, Oceanside, CA (US)

(73) Assignee: Ushio America, Inc., Cypress, CA (US)

( * ) Notice: Subject to any disclaimer, the term of this patent is extended or adjusted under 35 U.S.C. 154(b) by 0 days.

(21) Appl. No.: 11/031,317

(22) Filed: Jan. 7, 2005

(65) Prior Publication Data

US 2006/0152871 A1 Jul. 13, 2006

(51) Int. Cl.
*H01J 61/067* (2006.01)
*H01J 13/28* (2006.01)

(52) U.S. Cl. ..... 315/108; 315/109

(58) Field of Classification Search ..... 315/56–64, 315/246, 124, 224, 225, 291, 209 R, 108–110, 315/194
See application file for complete search history.

(56) References Cited

U.S. PATENT DOCUMENTS 4,471,268 A * 9/1984 Brown et al. ..... 315/178
4,803,406 A * 2/1989 Yasuda et al. ..... 315/174
5,109,181 A * 4/1992 Fischer et al. ..... 313/571
5,604,406 A * 2/1997 Gaus ..... 315/56
6,215,252 B1 * 4/2001 Stanton ..... 315/224
6,392,364 B1 * 5/2002 Yamamoto et al. ..... 315/291
6,788,009 B1 * 9/2004 Fujii et al. ..... 315/291
7,023,144 B1 * 4/2006 Suzuki et al. ..... 315/246
2004/0090184 A1 * 5/2004 Arimoto et al. ..... 315/59
2004/0119425 A1 * 6/2004 Okamoto et al. ..... 315/291
2004/0178733 A1 * 9/2004 Tukamoto et al. ..... 313/634

* cited by examiner

*Primary Examiner*—Don K. Wong
*Assistant Examiner*—Hung Tran Vy
(74) *Attorney, Agent, or Firm*—Greenberg Traurig LLC; Bradley D. Blanche

(57) ABSTRACT

A method of stabilizing an arc between electrode tips in a high pressure arc discharge lamp is provided comprising initially creating an arc between the pair of electrodes during a start-up phase of the lamp by supplying power to the lamp for a first period. The method then transitions the arc to attach itself between the tips of the electrodes by removing the power supplied to the lamp for a second period and then resupplying power to the lamp after completion of the second period. The first and second periods for respectively initially supplying and removing power are preferably selected based on either an elapsed period of time, the measured operating lamp voltage, or the measured lamp pressure. Once the arc becomes attached to the tips of the electrodes in this manner, the arc will remain stabilized between the electrode tips during operation of the discharge lamp.

29 Claims, 6 Drawing Sheets

$V_L$
$I_L$
t

METHOD FOR ARC ATTACHMENT STABILIZATION

BACKGROUND OF THE INVENTION

1. Technical Field

The present invention relates to the field of arc discharge lamps, and in particular to a method of stabilizing arc attachment in arc discharge lamps.

2. Description of Related Art

High pressure discharge lamps generate light by passing an electrical current from one electrode to another electrode through a metal vapor sealed inside a discharge vessel to form an arc between the electrodes. Discharge lamps include a discharge chamber or vessel 10 contained within an outer bulb 12, as illustrated in FIG. 1. The discharge vessel 10 typically includes a cathode 14, an anode 16, a starting gas 18 and a metal. When an electric field is passed between the cathode 14 and anode 16, the starting gas 18 ionizes, which decreases the resistance between the electrodes 14, 16 and creates an arc between them. The charged arc emits visible light and ultraviolet light when excited electrons return to lower orbitals.

High pressure discharge lamps typically utilize mercury or other various emission metals and halogens (metal halides) to enhance the light output and brightness. A short arc type discharge lamp may comprise a mercury discharge lamp, a metal halide lamp or another high pressure discharge lamp in which the distance between the two electrodes where the arc is established is relative small, e.g. approximately 5 mm or less. Short arc mercury lamps are often used in the photochemical industrial field, semiconductor device manufacturing field, projector field and the like. In such discharge lamps, a coil 20 serves as the starting point of discharge at startup time of lamp and is fixed on the starting electrode 14 so as to contact the side surface of the electrode 14. During startup of this kind of short arc type discharge lamp, when a power supply applies an electrical current across the lamp electrodes 12, 14, typically a glow discharge is started between the anode 16 and the coil 20 fixed to the side surface of the cathode 14, and gradually shifts to an arc discharge. The heat of the coil 20 heated by the discharge is conducted to the cathode 14 to which the coil 20 is fixed. Furthermore, the cathode 14 is subjected to radiation heat due to the arc from the coil 20, which leads to the state in which thermoelectrons are easily emitted. As the internal pressure of the lamp increases, the arc ideally narrows down to be stable and the stabilized arc discharge ideally shifts to the tip of the cathode 14 to generate a stationary lit up state of the lamp.

However, with the above-mentioned kind of short arc type discharge lamp, a problem arises that the arc discharge commenced from the coil 20 at startup time often becomes stabilized on the coil 20 and does not shift to the tip of the cathode 14. This kind of 'arc-hangup' phenomenon noticeably occurs during the initial low pressure stages during start up of the lamp, where the present inventors have found that approximately 80% of short arc type discharge lamps have the arc become stabilized on the coil 20. This 'arc-hangup' phenomenon tends to occur more frequently at lower pressures, because at higher pressures the arc will tend to seek the shortest distance between the electrodes, namely the distance between the electrode tips. This phenomenon is potentially thought to occur because the heat produced from the arc and emitted by the coil 20 is transferred from the coil 20 to the rear end part of the cathode 14 which makes contact with the coil 20, and, because additional thermal conduction to the bulb 12, the occurrence of thermoelectron emission at the tip of the electrode becomes difficult and whereby the arc remains on the coil 20 without being transferred to the tip of the electrode.

The 'arc-hangup' phenomenon produces an abnormal discharge that often causes the arc to contact the outer wall of the lamp and create problems such as lamp explosion, cloudiness of the lamp, or blackening of the lamp due to the vaporization of the coil 20 due to abnormal heating of the coil 20. Moreover, the length of the arc is much longer than the intended arc gap between the tips of the cathode 14 and anode 16, which makes the lamp unusable for most optical applications. These problems associated with such abnormal discharge negatively impact the intended properties of the discharge lamp and essentially render the lamp unusable.

Prior attempts to solve this 'arc-hangup' phenomenon have centered around changing the shape or design of the electrodes to promote an arc that extends between the electrode tips or by driving the lamp with a higher in-rush current to more greatly warm the electrodes. However, these solutions tend to overpower the electrodes and can cause them to wear out more quickly, aside from also presenting design limitations on discharge lamp manufacturers by requiring specific cathode shapes that may promote a stable tip-to-tip arc.

SUMMARY

The following is a summary of various aspects and advantages realizable according to various embodiments of the method for arc attachment stabilization for a discharge lamp according to the present invention. It is provided as an introduction to assist those skilled in the art to more rapidly assimilate the detailed discussion of the invention that ensues and does not and is not intended in any way to limit the scope of the claims that are appended hereto.

The various embodiments described below are directed to a method of stabilizing an arc between electrode tips in a high pressure arc discharge lamp. The lamp includes a pair of electrodes disposed inside a sealed discharge vessel with each electrode having a tip arranged on opposite ends of the discharge vessel with a gap extending between them. The electrodes are configured to receive power from a power supply attached to the lamp. The method for arc attachment stabilization comprises initially creating an arc between the pair of electrodes during start-up of the lamp by supplying power to the lamp for a first period. The arc is then transitioned to extend between the tips of the electrodes by removing the power supplied to the lamp for a second period and then resupplying power to the lamp after completion of the second period. The first and second periods for respectively initially supplying and removing power are selected based on at least one of the following: 1) an elapsed period of time, 2) the measured operating lamp voltage, 3) the measured lamp pressure, or 4) another operating condition signifying that the pressure and/or voltage within the discharge lamp are at suitable levels to promote transitioning of the arc to the tips of the electrodes. Once the arc becomes attached to the tips of the electrodes according to this method, the arc will remain stabilized between the electrode tips during operation of the discharge lamp.

BRIEF DESCRIPTION OF THE DRAWINGS

The features of the present invention, which are believed to be novel, are set forth with particularity in the appended claims. The present invention, both as to its organization and manner of operation, together with further advantages, may best be understood by reference to the following description, taken in connection with the accompanying drawings in which the reference numerals designate like parts throughout the figures thereof and wherein:

DETAILED DESCRIPTION OF THE INVENTION

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein specifically to provide a method of arc attachment stabilization in an arc discharge lamp.

Figure 1:
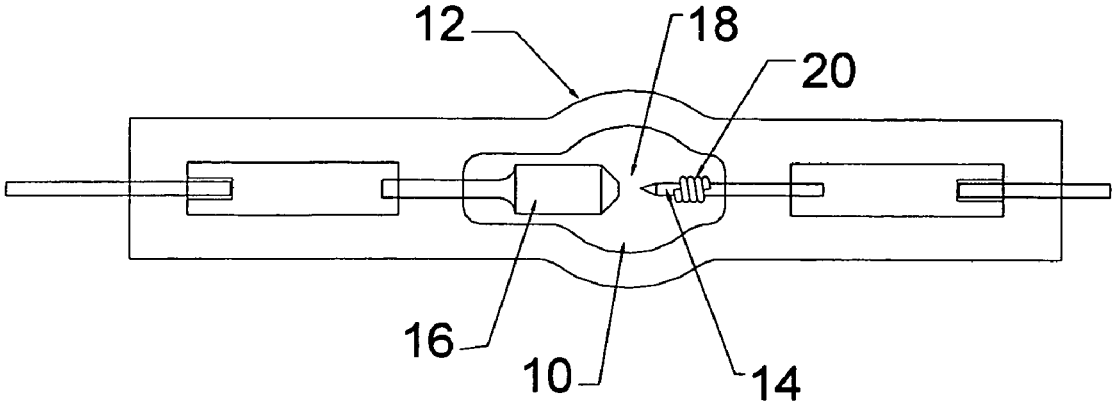
FIG. 1 is a schematic side view of a short arc type discharge lamp.
Figure 2:
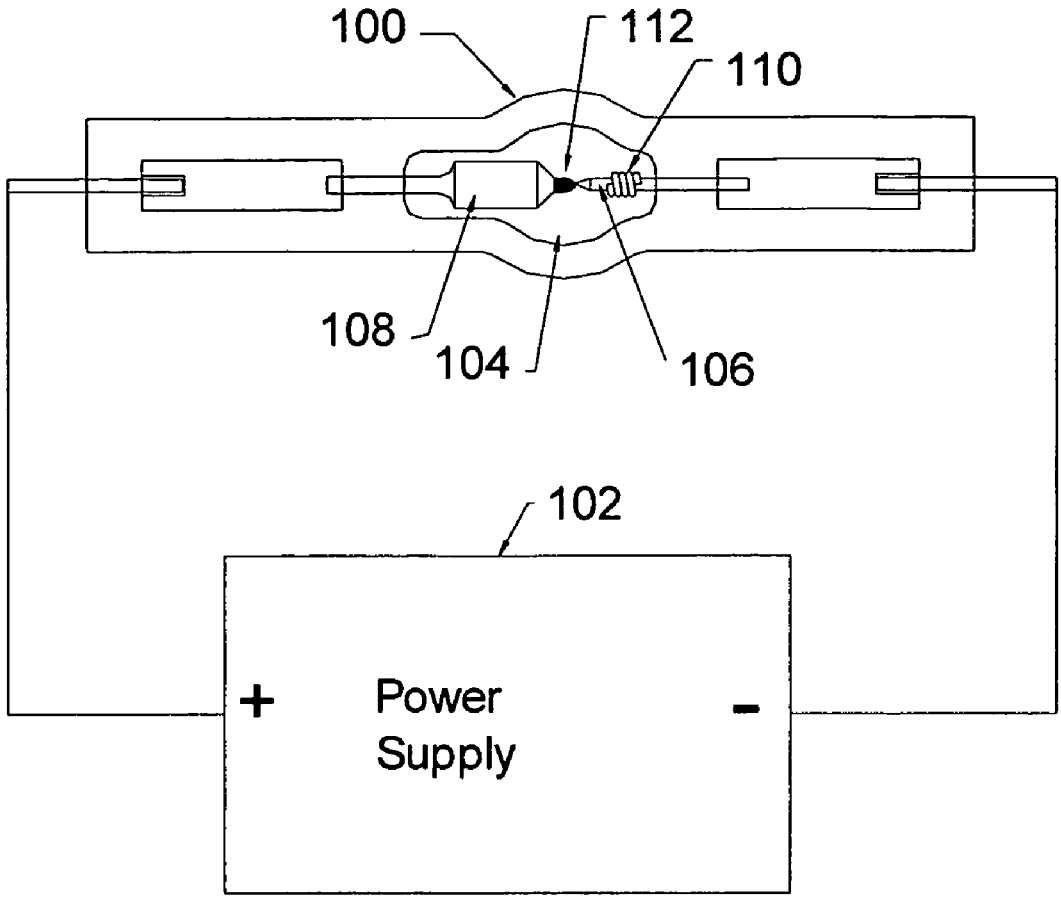
FIG. 2 is a schematic view of a short arc type discharge lamp connected to a power supply in accordance with a preferred embodiment of the present invention.

Referring now to FIG. 2, a high pressure arc discharge lamp 100 is illustrated as being attached to a power supply 102 in accordance with a preferred embodiment. The term discharge lamp 100 used herein includes short arc mercury based high pressure discharge lamps, metal halide lamps, long arc discharge lamps and other high pressure discharge lamps which are prone to experiencing the arc-hangup phenomenon. The discharge lamp 100 includes a starting gas and a metal (e.g., mercury, metal halide, etc.) sealed inside a discharge chamber or vessel 104. A pair of electrodes, a cathode 106 and an anode 108, are also situated within opposite ends of the discharge vessel 104. For short arc discharge lamps, the distance between two electrodes 106, 108 should be approximately 5 mm or less. The cathode 106 includes a wire coil 110 wound around a portion thereof. The cathode 106 and anode 108 are connected to receive power from the power supply 102, and the power supply 102 will supply power by applying a fixed current across the cathode 106 and anode 108. An arc is established between the cathode 106 and the anode 108 which emits plasma radiation. The electric field of the arc is related to the internal pressure of the vessel 104, which is mainly given by the pressure of the evaporating metal.

Figure 3:
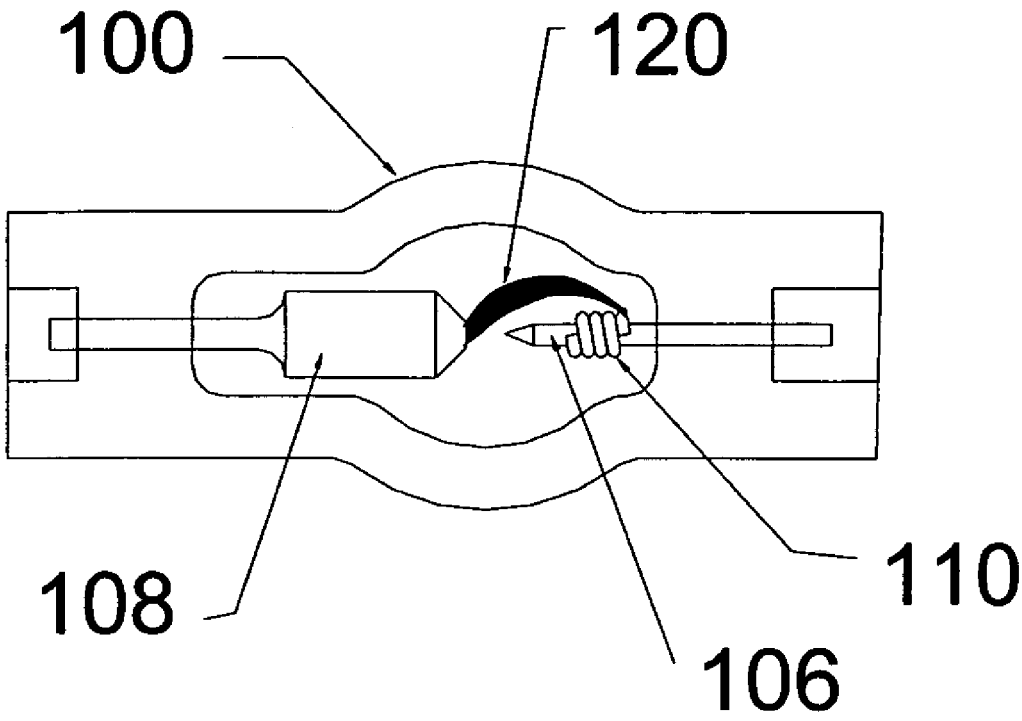
FIG. 3 is a schematic view of a short arc type discharge lamp experiencing the arc-hangup phenomenon.

After the discharge lamp 100 is started and power is initially supplied to it, the operating voltage of the discharge lamp 100 will gradually increase. Similarly, the pressure within the discharge vessel 104 gradually increases from an initial lower level pressure to a higher pressure level over time in accordance with the increasing temperature of the vessel 104. When the pressure within the discharge lamp 100 is low, such as during the low pressure starting phase of the discharge lamp 100, the discharge lamp 100 is prone to the arc-hangup phenomenon and the arc tends to attach itself between the anode 108 and the coil 110, as shown by the arc 120 illustrated in FIG. 3. As previously described, this is an abnormal discharge that can cause low output, flickering, overheating of the bulb, possible non-passive failures and enhanced blackening of the bulb. Ideally, as the pressure in the discharge vessel 104 increases, the arc should transition itself to the tip 122 of the cathode 106. However, the present inventors found that approximately only 20% of particular arc discharge lamps tested actually transitioned the arc to the tip 122 of the cathode 106 when operated according to previously-known techniques. Once the arc attached itself on the coil 110 in prior discharge lamps, the arc stabilized itself there and remained on the coil 110 in all of the discharge lamps.

Figure 4:
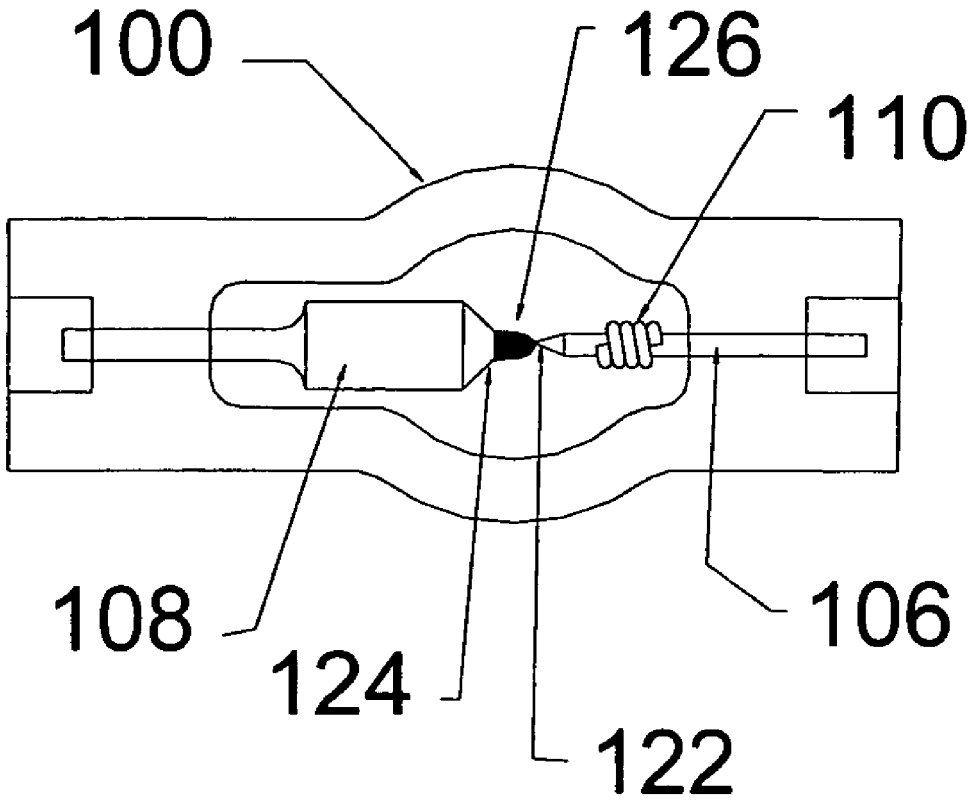
FIG. 4 is a schematic view of a short arc type discharge lamp having its arc stabilized between its electrode tips in accordance with a preferred embodiment of the present invention.

In order to transition the arc from the coil 110 to the tip 122 of the cathode 106 in a preferred embodiment, the discharge lamp 100 is switched off for a short period of time and then immediately restarted. The present inventors have found that after this restart, the arc will safely attach to the tip 122 of the cathode 106 and remain stabilized between the tip 122 of the cathode 106 and the tip 124 of the anode 108, as illustrated by the arc 126 in FIG. 4. By interrupting the power supplied to the discharge lamp 100 during lamp the start-up phase, the present inventors have achieved a 100% success rate in transitioning and stabilizing the arc between the respective tips 122, 124 of the cathode 106 and anode 108. This provides a dramatic improvement over the mere 20% success rate for arc transfer and stabilization previously achievable using prior methods of operation.

Figure 5A:
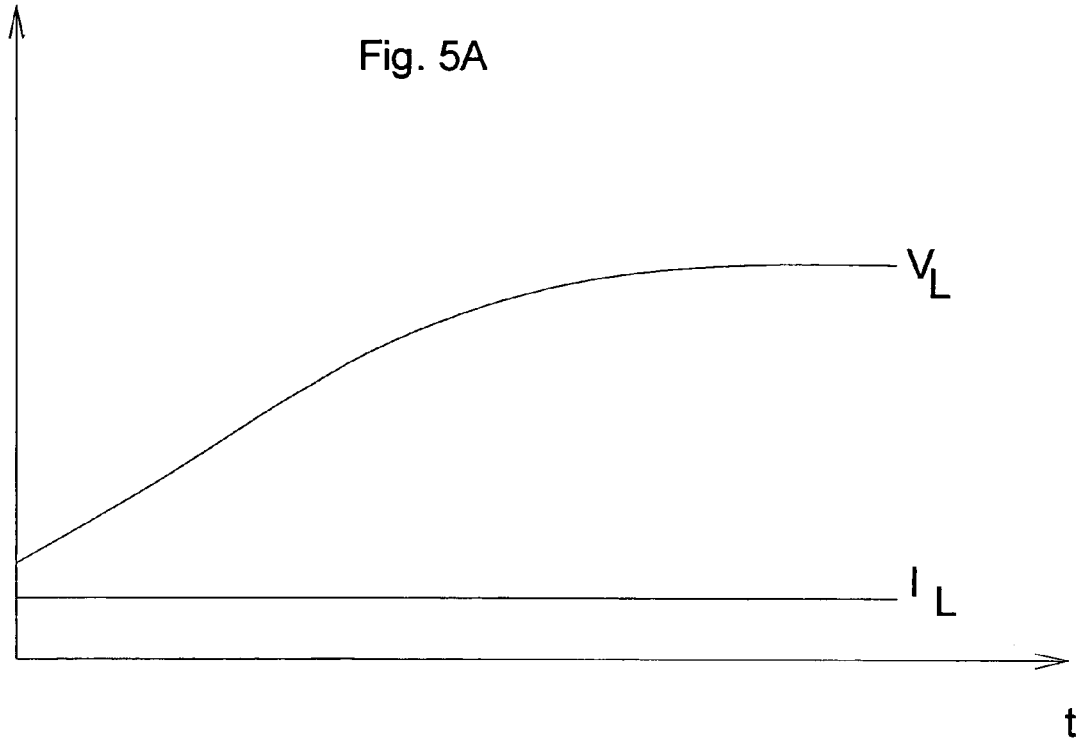
FIG. 5A is a graphical illustration of the lamp voltage and driving current supplied from the power supply over time.

Power is supplied to the discharge lamp 100 by applying a current across the electrodes 106, 108. This current warms the electrodes 106, 108 and limits the amount of blackening of the lamp bulb during the start-up phase. As time progresses while the current is being applied, the operating voltage and pressure in the discharge lamp 100 will gradually increase toward across a final operating voltage and pressure of the discharge lamp 100. Referring now to FIG. 5A, a graphical illustration is provided showing the relationship of the lamp voltage $V_L$ and the driving current $I_L$ over time under circumstances where the power is not interrupted. The pressure (not illustrated) within the discharge lamp 100 will increase over time as the current $I_L$ is supplied by the power supply 102 in a similar manner as the increasing lamp voltage $V_L$, since the lamp pressure and voltage are related to each another.

Figure 5B:
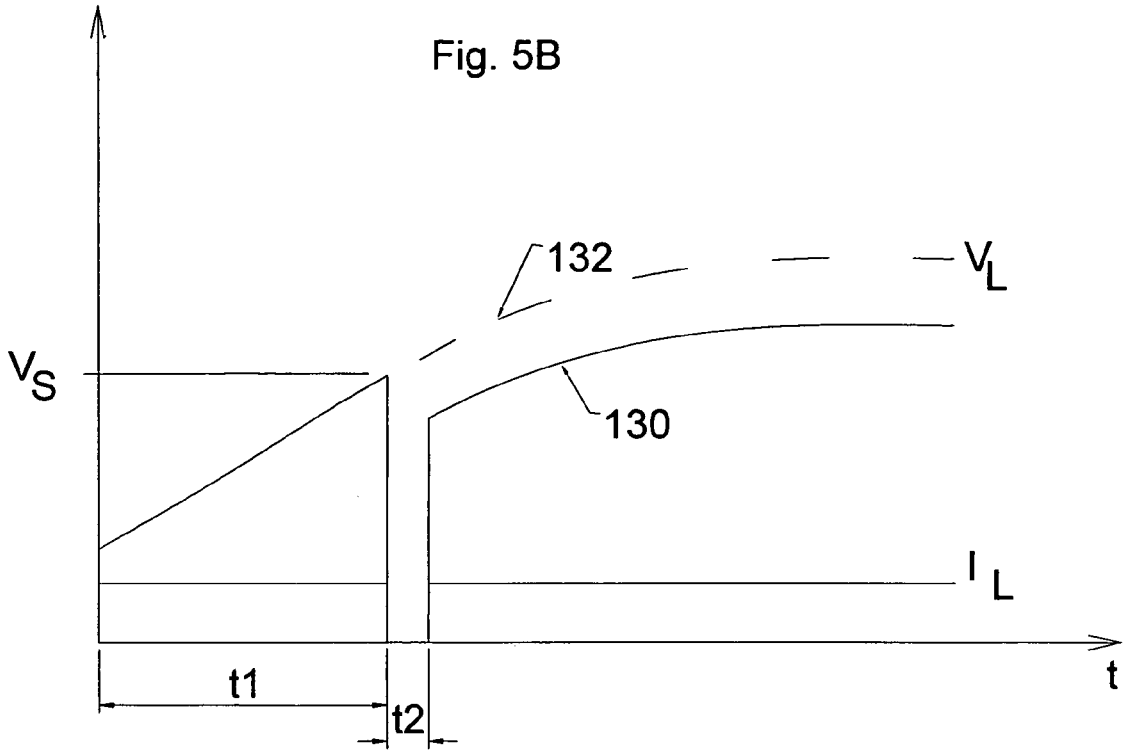
FIG. 5B is a graphical illustration of the lamp voltage and power supply driving current over time in accordance with a preferred embodiment the method for arc attachment stabilization.

In the preferred embodiment, power is supplied to the discharge lamp 100 for a first period of time $t_1$ until a first operating condition occurs. After the first operating condition is found to have occurred, power is removed from the discharge lamp 100 for a second period of time $t_2$ until a second operating condition occurs. In the preferred embodiment, power is shut off by removing the driving current $I_L$ being supplied by the power supply 102 to the discharge lamp 100 for the second period of time $t_2$, as illustrated in FIG. 5B. Once the second operating condition occurs, the current $I_L$ is resupplied to the discharge lamp 100. As can be seen from FIG. 5B, the operating lamp voltage $V_L$ will drop during the second period of time $t_2$ when the current $I_L$ is removed. Depending upon the thermal conditions of the discharge lamp 100, the temperature of the discharge lamp 100 should also decrease when power is removed during the second period of time $t_2$, wherein the lamp pressure is related to the temperature of the discharge lamp 100 and will correspondingly also drop with the dropping temperature during the second period of time $t_2$. When power is resupplied to the discharge lamp 100, the operating lamp voltage $V_L$ will once again gradually increase toward its intended maximum voltage, as illustrated by the curve 130 representing the operating lamp voltage $V_L$ after power is resupplied to the discharge lamp 100. Likewise, the temperature of the discharge lamp 100 should gradually increase after power is resupplied, resulting in a gradual increase in the operating lamp pressure $P_L$. After performing these steps, the arc will transition from the coil 110 to the tip 122 of the cathode 106 and remain stabilized between the tips 122, 124 of the two electrodes 106, 108. Dashed curve 132 illustrates how the operating lamp voltage $V_L$ would have performed if the current $I_L$ had not been interrupted.

The first and second operating conditions may be 1) an elapsed period of time, 2) a measured operating lamp voltage $V_L$, 3) a measured lamp pressure $P_L$, or 4) when another operating condition occurs signifying that the pressure and/or voltage within the discharge lamp 100 are at suitable levels to promote transitioning of the arc to the respective tips 122, 124 of the cathode 106 and anode 108. As described above, the operating lamp voltage $V_L$ and the lamp pressure $P_L$ will increase over time as the driving current $I_L$ is supplied (as shown in FIGS. 5A and 5B) and will decrease over time when the driving current $I_L$ is removed. The first period of time $t_1$ and the second period of time $t_2$ are selected to create desired operating conditions in the lamp that promote the transfer of the arc from the coil 110 to the tip 122 of the cathode 106. In order to accomplish this arc transfer, the temperature of the coil 110 on the cathode 106 must cool down enough during the second period of time $t_2$ when power is removed such that the arc does not immediately become drawn back to the coil 110 when power is resupplied to the discharge lamp 110. This cooling down of the coil 110 must be balanced against the lamp pressure $P_L$, because the lamp pressure $P_L$ cannot be allowed drop too far or it will enter a low pressure state where the arc-jump phenomenon is prone to occur. Since the temperature of the coil 110 will increase the longer the arc remains fixed on the coil and further since the lamp pressure steadily increases as the driving current $I_L$ is supplied, the first period of time $t_1$ and the second period of time $t_2$ must be selected relative to one another to create the proper operating conditions within the discharge lamp that will allow the arc to transition from the coil 110 to the tip 122 of the cathode 106.

In order to determine the time periods that the power supply 102 should initially supply power to the discharge lamp 100 ($t_1$) and should remove power from the discharge lamp 100 ($t_2$), either i) the lamp voltage $V_L$, ii) the lamp pressure $P_L$, iii) the time that the power supply is supplying or removing power, or iv) any combination of these factors can be monitored and selected to create the proper operating conditions within the discharge lamp 100 to promote arc transfer to the electrode tips, because each of these factors are related and any of them could be monitored alone or in combination to determine when the desired operating conditions for arc transfer have been reached.

In one preferred embodiment, power is supplied to the discharge lamp 100 for a first period of time $t_1$ until the lamp voltage $V_L$ reaches a desired voltage $V_S$, as shown in FIG. 5B. The desired voltage $V_S$ may be any voltage corresponding to a lamp pressure $P_L$ high enough such that the arc-hangup phenomenon will not occur after power is removed and resupplied to the discharge lamp 100. Since the lamp voltage $V_L$, the lamp pressure $P_L$ and the time that the power supply is supplying the driving current $I_L$ are all dependently related to each other, any of these factors may be monitored if their relationship to the desired voltage $V_S$ was known. Likewise, the second period of time $t_2$ during which power is removed from the discharge lamp 100 should be selected to allow the lamp pressure $P_L$ to remain high enough to inhibit the arc-hangup phenomenon when power is resupplied to the discharge lamp 100. Naturally, the first period of time $t_1$ and the second period of time $t_2$ will be dependent upon one another and may be variably selected with respect to each other depending upon the particular type of discharge lamp being operated.

The desired cutoff voltage $V_S$ for initially supplying power is selected to be approximately one-half of the final operating voltage of the discharge lamp 100 in a preferred embodiment. The half way point of the final operating voltage is selected in this embodiment, because the voltage cutoff must not be selected to be too low or else the lamp pressure will also be too low and can still allow the arc-hangup phenomenon to occur. The lamp pressure, and correspondingly the lamp voltage, must be high enough to inhibit the arc-jump phenomenon. The arc-jump phenomenon is inhibited from occurring at voltages of approximately one-half of the final operating voltage of the discharge lamp 100 or greater. While the cutoff voltage $V_S$ could be selected to be values much higher than this half-way voltage point, it is not preferable to select voltages that are much greater than one-half of the final operating voltage because they will require much greater ignition voltages to restart the lamp. In the preferred embodiment, power is removed from the discharge lamp 100 for a second period of time $t_2$ between approximately 1 millisecond to 2 seconds, preferably approximately 200 ms. Again, the actual time periods during which power is initially supplied and removed will vary between different types of discharge lamps and should be fine tuned according to the above-described factors influencing the operating conditions of the particular discharge lamps. The second period of time $t_2$ is also preferably selected to be short enough that the actual interruption of the power being supplied is not particularly noticeable to a user, aside from the noticeable transition of the arc from the coil 110 to the tip 122 of the cathode 106.

In an alternative embodiment, the desired cutoff voltage $V_S$ for initially supplying power may be selected to be when the operating voltage $V_L$ of the discharge lamp 100 reaches or exceeds its intended normal operating voltage.

After supplying, removing and resupplying power to the discharge lamp 100 in accordance with the method of the present invention, the arc transitions itself to and stabilizes between the respective tips 122, 124 of the electrodes 106, 108. The arc will subsequently remain stabilized between the tips 122, 124 during operation of the discharge lamp 100. As such, this switching off and restarting of the discharge lamp 100 is only required to be executed a single time during the start-up phase of the discharge lamp 100, because the arc will remain stabilized between the tips 122, 124 of the electrodes 106, 108 until the lamp is turned off at some point in the future. The inventors have found a 100% success rate in arc attachment stabilization between the tips 122, 124 of the electrodes 106, 108 when utilizing the present method. Thus, the arc attachment stabilization method is only required to be performed once. Further, by only performing the method of arc attachment stabilization a single time, the discharge lamp 100 is prevented from continually restarting itself every time the first operating condition (e.g., the cutoff voltage $V_S$) is reached. However, to account for unusual situation where the arc-hangup phenomenon occurs more than once, the method of arc attachment stabilization of the present invention could simply be modified in an alternative embodiment to repeat its steps to again transition and stabilize the arc to the tips 122, 124 of the electrodes 106, 108.

The power supplied, removed and resupplied to the discharge lamp 100 is controlled automatically by the power supply 102 in a preferred embodiment of the method of arc attachment stabilization. To perform this automated control, the power supply 102 may include a programmable microprocessor or other circuitry for performing the functions associated with the method of arc attachment stabilization in an automated manner without requiring user intervention. Alternatively, the power supply 102 may include a feature allowing the method of arc attachment stabilization to be user activatable in situations where additional arc stabilization is deemed required by a user.

By operating a discharge lamp in accordance with the method of arc attachment stabilization of the present invention, the problems associated with the arc-jump phenomenon are wholly solved and the arc in the discharge lamp can be stabilized between the tips of the electrodes in the discharge lamp. This method of arc attachment stabilization will improve lamp efficiency, prevent lamp blackening and greatly improve the life the discharge lamp.

The different structures and methods of the arc attachment stabilization method of the present invention are described separately in each of the above embodiments. However, it is the full intention of the inventors of the present invention that the separate aspects of each embodiment described herein may be combined with the other embodiments described herein. Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

The invention claimed is:

1. A method of stabilizing an arc between desired portions of electrodes in an arc discharge lamp, comprising:

creating an arc between the electrodes in the lamp by initially supplying power to the lamp until a first operating condition is met;

removing the power supplied to the lamp until a second operating condition is met; and resupplying power to the lamp after the second operating condition is met in order to stabilize the arc between desired portions of the electrodes.

2. The method of claim 1, wherein the first operating condition is a period of time in which power is supplied to the lamp.

3. The method of claim 1, wherein the first operating condition is a desired voltage, said method further comprising:

measuring a voltage of the lamp;

initially supplying power to the lamp until the measured voltage reaches the desired voltage; and removing the power supplied to the lamp after the measured voltage reaches the desired voltage until the second operating condition is met.

4. The method of claim 3, wherein the desired voltage is approximately one-half of a final operating voltage of the lamp.

5. The method of claim 1, wherein the first operating condition is a desired pressure, said method further comprising:

measuring a pressure within the lamp;

initially supplying power to the lamp until the measured pressure reaches a desired pressure; and removing the power supplied to the lamp after the measured pressure reaches the desired pressure until the second operating condition is met.

6. The method of claim 1, wherein a voltage and a pressure of the lamp are dependent upon the power supplied to the lamp, such that the first and second operating conditions are dependent upon the voltage and pressure of the lamp.

7. The method of claim 1, wherein said lamp includes a pair of electrodes with each electrode having a tip for forming an arc there between the tips of the electrodes during operation of the lamp, wherein the tips of the electrodes are the desired portions of the electrodes between which the arc is stabilized when power is resupplied to the lamp after completion of the second operating condition.

8. The method of claim 1, wherein the second operating condition is a period of time between approximately 1 millisecond to 2 seconds during which power is removed from the lamp.

9. The method of claim 8, wherein the period of time of the second operating condition is 200 milliseconds.

10. The method of claim 1, wherein the lamp is a short arc type discharge lamp having a pair of electrodes separated by approximately 5 mm or less.

11. A method of stabilizing an arc between electrode tips in an arc discharge lamp, wherein the lamp includes a pair of electrodes disposed inside a sealed discharge vessel with each electrode having a tip with a gap extending there between, wherein the electrodes are configured to receive power from a power supply attached to the lamp, the method comprising:

initially creating an arc between the pair of electrodes during start-up of the lamp by supplying power to the lamp for a first period; and transitioning the arc to extend between the tips of the electrodes by:

removing the power supplied to the lamp for a second period; and resupplying power to the lamp after completion of the second period.

12. The method of claim 11, wherein the first period is determined by a period of time.

13. The method of claim 11, further comprising:

measuring a voltage of the lamp;

supplying power to the lamp during the first period until the measured voltage reaches a desired voltage; and removing the power supplied to the lamp for the second period after the measured voltage reaches the desired voltage.

14. The method of claim 13, wherein the desired voltage is approximately one-half of a final operating voltage of the lamp.

15. The method of claim 11, further comprising:

measuring a pressure within the lamp;

supplying power to the lamp during the first period until the measured pressure reaches a desired pressure; and removing the power supplied to the lamp for the second period after the measured pressure reaches the desired pressure.

16. The method of claim 11, wherein a voltage and a pressure of the lamp are dependent upon the power supplied to the lamp, such that said method further comprises decreasing the voltage and the pressure of the lamp during the second period when the power being supplied to the lamp is removed.

17. The method of claim 11, wherein the second period is between approximately 1 millisecond to 2 seconds.

18. The method of claim 17, wherein the second period is 200 milliseconds.

19. The method of claim 11, wherein the lamp is a short arc type discharge lamp having a pair of electrodes separated by approximately 5 mm or less.

20. The method of claim 11, wherein power is supplied to the lamp by applying a fixed current across the electrodes.

21. The method of claim 11, wherein the power supply is configured to automatically perform the steps of supplying, removing and resupplying power.

22. A short arc type discharge lamp system, comprising:

a short arc type discharge lamp including a pair of electrodes disposed inside a sealed discharge vessel with each electrode having a tip, wherein a gap extends between the electrode tips; and a power supply connected to the discharge lamp such that the electrodes receive power from the power supply, wherein the power supply is configurable to perform the following steps:

initially create an arc between the pair of electrodes during start-up of the lamp by supplying power to the lamp for a first period;

remove the power supplied to the lamp to extinguish the arc for a second period; and resupply power to the lamp after completion of the second period to stabilize the arc to extend between the tips of the electrodes.

23. The short arc type discharge lamp system of claim 22, wherein the first period is determined by a period of time.

24. The short arc type discharge lamp system of claim 22, wherein the power supply is further configurable to perform the following steps:

measure the voltage supplied to the lamp;

supply power to the lamp during the first period until the measured voltage reaches a desired voltage; and remove the power supplied to the lamp for the second period after the measured voltage reaches the desired voltage.

25. The short arc type discharge lamp system of claim 24, wherein the desired voltage is approximately one-half of a final operating voltage of the lamp.

26. The short arc type discharge lamp system of claim 22, further comprising a pressure detector for measuring a pressure within the lamp, wherein the power supply is further configurable to perform the following steps:

supply power to the lamp during the first period until the measured pressure reaches a desired pressure; and remove the power supplied to the lamp for the second period after the measured pressure reaches the desired pressure.

27. The short arc type discharge lamp system of claim 22, wherein the second period is between approximately 1 millisecond to 2 seconds.

28. The short arc type discharge lamp system of claim 27, wherein the second period is 200 milliseconds.

29. The short arc type discharge lamp system of claim 22, wherein the lamp is a short arc type discharge lamp having a pair of electrodes separated by approximately 5 mm or less.

* * * * *